US012703987B2

(12) United States Patent
Klaus

(10) Patent No.: US 12,703,987 B2
(45) Date of Patent: Aug. 11, 2026

(54) SLIP FORM CONSTRUCTION SYSTEMS AND METHODS FOR USE

(71) Applicant: KLAUS AND ASSOCIATES, INC., Highland, IL (US)

(72) Inventor: Harold Paul Klaus, Highland, IL (US)

(73) Assignee: KLAUS AND ASSOCIATES, INC., Highland, IL (US)

( * ) Notice: Subject to any disclaimer, the term of this patent is extended or adjusted under 35 U.S.C. 154(b) by 636 days.

(21) Appl. No.: 17/963,323

(22) Filed: Oct. 11, 2022

(65) Prior Publication Data

US 2023/0030796 A1 Feb. 2, 2023

Related U.S. Application Data

(63) Continuation-in-part of application No. 16/726,494, filed on Dec. 24, 2019, now Pat. No. 11,549,272.

(51) Int. Cl.
*E04G 11/24* (2006.01)

(52) U.S. Cl.
CPC ..... *E04G 11/24* (2013.01)

(58) Field of Classification Search
CPC ..... E04G 11/24; E04G 17/002
USPC ..... 425/63; 249/21
See application file for complete search history.

(56) References Cited

U.S. PATENT DOCUMENTS 1,235,542 A 8/1917 Bagby
1,375,109 A 4/1921 Rossiter et al.
1,393,506 A 10/1921 Copeland
1,554,420 A 9/1925 Donley
3,510,098 A 5/1970 Fox
3,638,901 A 2/1972 Williams
3,705,776 A * 12/1972 Johansson ..... E04G 11/22 249/20
3,778,204 A 12/1973 Kuck
3,897,182 A 7/1975 Heinzle
3,966,376 A 6/1976 Heinzle
(Continued)

FOREIGN PATENT DOCUMENTS

CN 201460203 U * 5/2010
EP 0350525 A1 * 1/1990
(Continued)

OTHER PUBLICATIONS

English translation of EP-0350525-A1 by EPO. (Year: 1990).*
(Continued)

*Primary Examiner* — Inja Song
(74) *Attorney, Agent, or Firm* — STINSON LLP

(57) ABSTRACT

A slip form assembly and a slip form construction system are provided. The slip form construction system includes a first slip form assembly including a first lifting pole extending longitudinally, a first inner form slidably coupled to the first lifting pole, and a first outer form slidably coupled to the first lifting pole opposite the first inner form such that a first cavity for casting a first portion of a wall is defined therebetween. At least one panel is coupled to at least one of the first inner form and the first outer form such that the at least one panel forms at least a partial inner surface of at least one of the first inner form and the first outer form wherein concrete poured into the first cavity engages the panel and is prevented from engaging an inner surface of either the first inner or outer forms.

17 Claims, 12 Drawing Sheets

(56) References Cited

U.S. PATENT DOCUMENTS

| | | | | |
|---|---|---|---|---|
| 4,108,583 | A | 8/1978 | Ellen | |
| 4,122,648 | A | 10/1978 | Godwin | |
| 4,253,810 | A | 3/1981 | Bezhanov et al. | |
| 4,312,492 | A | 1/1982 | Andersson | |
| 5,012,627 | A | 5/1991 | Lundmark | |
| 5,198,235 | A | 3/1993 | Reichstein et al. | |
| 5,263,835 | A | 11/1993 | Schmidt | |
| 6,260,311 | B1 | 7/2001 | Vladikovic | |
| 7,004,737 | B2 | 2/2006 | Russell | |
| 7,503,151 | B2 | 3/2009 | Simmons | |
| 8,621,817 | B1 | 1/2014 | Kreizinger | |
| 9,375,861 | B2 | 6/2016 | Schibsbye | |
| 9,388,598 | B2 | 7/2016 | Stiesdal | |
| 9,587,413 | B2 | 3/2017 | Horn et al. | |
| 2002/0121586 | A1* | 9/2002 | Gates | E04G 17/06 29/469 |
| 2003/0034576 | A1* | 2/2003 | Russell | E04G 17/002 264/33 |
| 2015/0069647 | A1* | 3/2015 | Ciuperca | C04B 7/02 249/13 |
| 2019/0308342 | A1* | 10/2019 | Butler | B01F 25/43161 |

FOREIGN PATENT DOCUMENTS

| | | | | |
|---|---|---|---|---|
| EP | 0982449 | A1 | | 3/2000 |
| EP | 2090718 | A2 | | 8/2009 |
| JP | H0726898 | A | | 1/1995 |
| JP | 2001152662 | A | * | 6/2001 |
| WO | 2014062062 | A1 | | 4/2014 |

OTHER PUBLICATIONS

English translation of JP-2001152662-A by EPO. (Year: 2001).*

LDPE, commercially available at least on Jul. 22, 2021 or after; available at https://web.archive.org/web/20210722092856/https://www.thermofisher.com/us/en/home/life-science/lab-plasticware-supplies/plastic-material-selection/low-density-polyethylene-ldpe-labware.html. (Year: 2021).*

Protolabs—available at https://www.protolabs.com/resources/design-tips/uv-resistant-plastics/. (Year: 2025).*

Polyalto—available at https://blogue.polyalto.com/en/5-plastics-uv-resistance. (Year: 2025).*

English translation of CN-201460203-U by EPO. (Year: 2010).*

* cited by examiner

SLIP FORM CONSTRUCTION SYSTEMS AND METHODS FOR USE

CROSS-REFERENCE TO RELATED APPLICATIONS

This application is continuation-in-part application of U.S. application Ser. No. 16/726,494, filed Dec. 24, 2019, which is incorporated herein by reference in its entirety.

BACKGROUND

The field of the disclosure relates generally to construction systems and, more particularly, to slip form assemblies for use in slip form construction systems.

At least some known construction systems typically involve precast forms used for forming concrete. For example, at least some known construction systems utilize "tilt-up panels", which generally utilize using wood forms, rebar and concrete. The "tilt-up panels" are shaped to match the desired design shape of an exterior wall of a building and may be either built at a work site or precast prior to arriving at the work site. During construction, concrete is poured into the tilt-up panels, with the panels oriented in a "face-down" position (i.e., such that the walls are oriented horizontally). After the concrete is cast and hardened in the forms, the walls are tilted into a vertical orientation (e.g., via a lifting crane) and set on foundational footings to form an exterior structure of a building. As a result, at least some known construction systems are generally costly to implement and are sensitive to surrounding weather when erecting the tilt-up panels.

Furthermore, at least some known construction systems utilize forms for pouring and casting the concrete walls in the vertical orientation. For example, at least some known construction systems utilize form panels positioned on both sides of a poured wall and surrounding a perimeter of the wall. Such form systems generally require high lifting capacity to uniformly lift the forms and, for example, additional work platforms coupled to the forms, about the entire perimeter of a building during construction. As a result, at least some known construction systems are generally cost prohibitive to implement in the construction of small to midsize structures (e.g., 60 feet and below).

Accordingly, it would be desirable to provide a construction system that allows for simpler and less costly construction of concrete walls for a structure.

BRIEF DESCRIPTION

In one aspect, a slip form assembly for use in a slip form construction system is provided. The slip form assembly includes a lifting pole, an inner form, an outer form, and at least one panel. The lifting pole extends in a longitudinal direction and the inner form is slidably coupled to the lifting pole and extends in a lengthwise direction perpendicular to the longitudinal direction between a first end and a second end. The outer form is slidably coupled to the lifting pole opposite the inner form and defines a cavity for casting a portion of a wall therebetween. The outer form extends parallel to the inner form and is spaced a distance from the inner form such that a cavity is defined therebetween. The outer form extends between a first end and a second end. The inner form and the outer form are moveable along the lifting pole in the longitudinal direction relative to the respective ends of the adjacent inner form and outer form. The at least one panel is coupled to at least one of the inner form and the outer form, such that the at least one panel forms at least a partial inner surface of at least one of the inner form and the outer form, such that the at least one panel engages concrete poured into the cavity and remains between the concrete and the at least one inner and outer form to which the at least one panel is coupled.

In another aspect, a slip form construction system is provided. The slip form construction system includes a first slip form assembly including a first lifting pole extending in a longitudinal direction, a first inner form slidably coupled to the first lifting pole, and a first outer form slidably coupled to the first lifting pole opposite the first inner form such that a first cavity for casting a first portion of a wall is defined therebetween. At least one panel is coupled to at least one of the first inner form and the first outer form such that the at least one panel forms at least a partial inner surface of at least one of the first inner form and the first outer form wherein concrete poured into the first cavity engages the at least one panel and is prevented from engaging an inner surface of at least one of the first inner form and the first outer form.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Embodiments described herein relate to slip form construction systems and slip form assemblies for slip form construction systems. The slip form assemblies each include a lifting pole extending in a longitudinal direction and an inner form and outer form each slidably coupled to the lifting pole. The inner forms and outer forms are moveable in the longitudinal direction relative to the respective ends of adjacent inner forms and outer forms. As a result, the slip form assemblies and slip form construction systems reduce costs and down time associated with constructing a concrete structure. In particular, the slip form assemblies and slip form construction systems described herein allow for independent lifting of slip form assemblies relative to one another, thereby reducing the total load on lifting mechanisms when raising the slip form assemblies. In addition, the independent lifting of slip form assemblies reduces downtime by enabling different lifting, pouring, molding, and casting processes to be performed simultaneously on different parts of the concrete structure.

Figure 1:
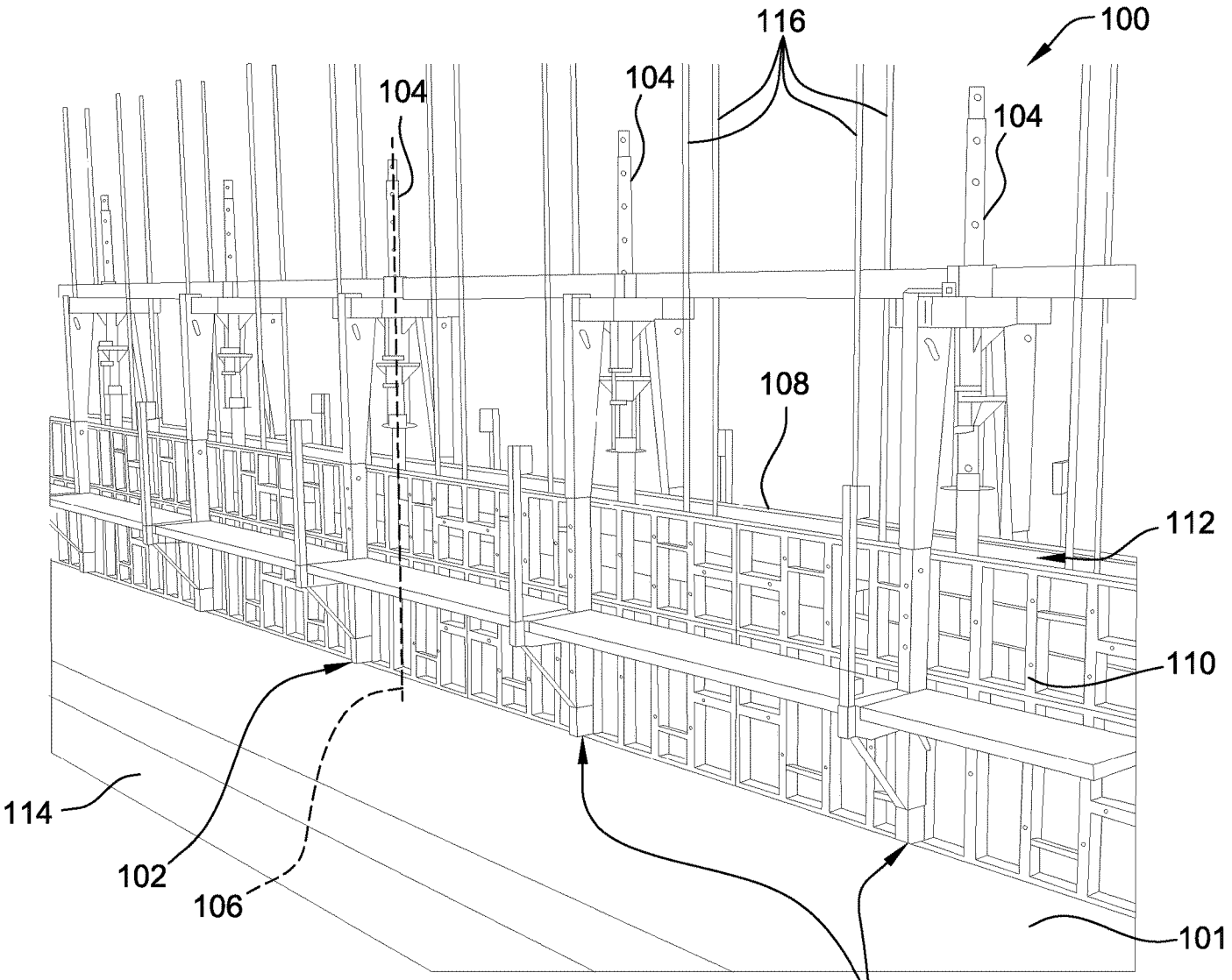
FIG. 1 is a schematic view of a portion of an exemplary slip form construction system including a plurality slip form assemblies.

FIG. 1 is a schematic view of a portion of an exemplary slip form construction system 100 including a plurality slip form assemblies 102. In the exemplary embodiment, slip form construction system 100 is configured to vertically construct a concrete wall 101. Slip form assemblies 102 each include a lifting pole 104 extending along a longitudinal axis, indicated generally at 106, an inner form 108 slidably coupled to lifting pole 104, and an outer form 110 slidably coupled to lifting pole 104 opposite inner form 108. Inner form 108 and outer form 110 define a cavity 112 therebetween for casting concrete wall. In particular, as shown in FIG. 1, five slip form assemblies 102 extend along a portion of concrete wall 101. Additional slip form assemblies extending along the entire wall 101 are not shown for clarity.

In the exemplary embodiment, slip form construction system 100 is configured to be positioned upon a portion of a foundation 114 and to build concrete wall 101 up from foundation 114. More specifically, in the exemplary embodiment, slip form assemblies 102 are configured to receive moldable concrete poured into cavity 112. Inner form 108 and outer form 110 are configured to mold concrete into a hardened uniform concrete wall 101. In the exemplary embodiment, inner forms 108 and outer forms 110 are configured to slidably engage concrete wall 101 to facilitate forming concrete wall 101. More specifically, inner forms 108 and outer forms 110 are configured to retain poured concrete within the cavity 112 such that concrete wall 101 has a substantially uniform width throughout. Additionally, inner forms and outer forms 108, 110 are configured to be incrementally moved longitudinally along lifting pole 104 as poured concrete hardens to form poured concrete vertically on top of hardened concrete.

In the exemplary embodiment, slip form construction system 100 includes a plurality of reinforcing bars 116 extending vertically through concrete wall 101 and configured to provide structural support for concrete wall 101 when completed. In alternative embodiments, slip form construction system 100 further includes insulation panels (not shown) positioned within the cavity 112 and configured to be molded into concrete wall 101 during construction.

Figure 2:
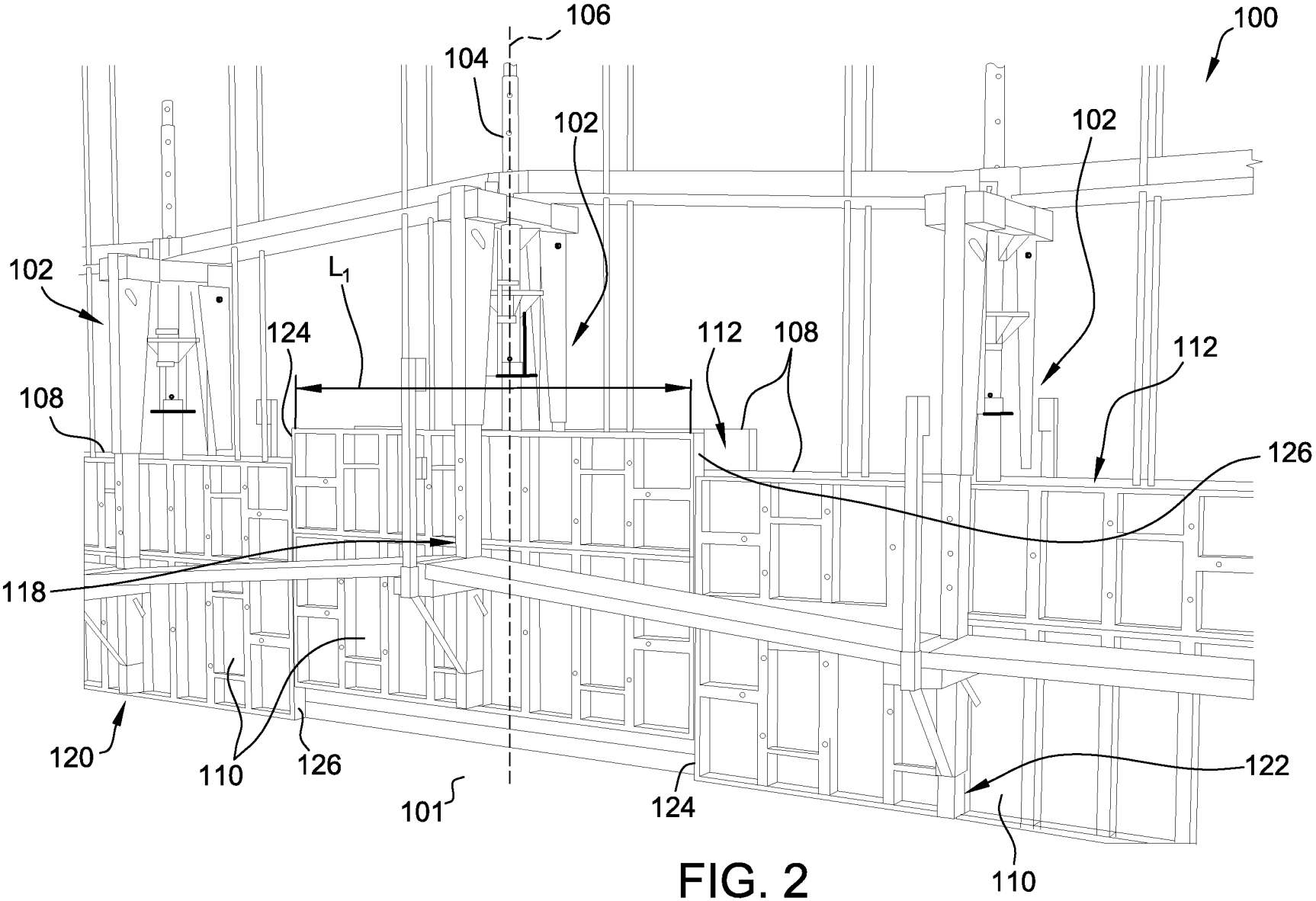
FIG. 2 is a schematic view of the slip form construction system shown in FIG. 1 including a first slip form assembly in a raised position relative to adjacent slip form assemblies.

FIG. 2 is a schematic view of slip form construction system 100 shown in FIG. 1 including a first slip form assembly 118 in a raised position relative to adjacent slip form assemblies 120, 122. In the exemplary embodiment, slip form construction system 100 includes first slip form assembly 118 positioned between a second slip form assembly 120 and a third slip form assembly 122. Inner forms 108 each extend a length (not shown) in a lengthwise direction perpendicular to the longitudinal direction, between a first end 124 and a second end 126. Likewise, outer forms 110 each extend a length, indicated generally at L1 in a direction parallel to the lengths of opposing inner forms 108 between a first end 124 and a second end 126. In particular, in the exemplary embodiment, inner forms 108 and outer forms 110 have approximately the same length. In alternative embodiments, inner forms 108 and outer forms 110 are sized in any manner that enables slip form construction system 100 to operate as described herein. For example, and without limitation, in some alternative embodiments, an outer form (not shown) has a greater length than its corresponding inner form (not shown) to facilitate forming an arced portion of a perimeter of a concrete wall 101.

Figure 9:
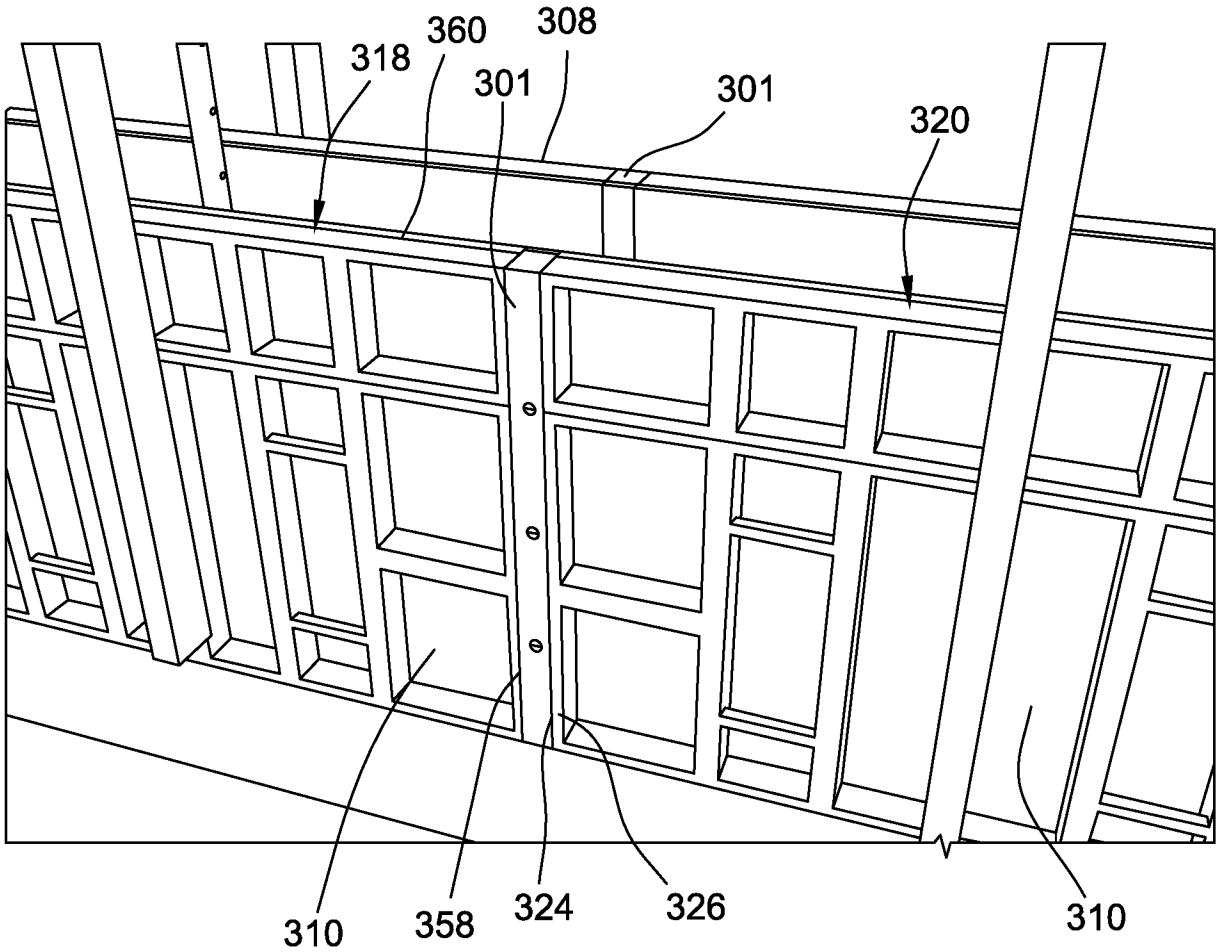
FIG. 9 is a schematic, perspective view of an alternative slip form assembly for use in the slip form construction system of FIG. 1.

In the exemplary embodiment, first end 124 and second end 126 of inner forms 108 and outer forms 110 are positioned adjacent to respective inner forms 108 and outer forms 110 such that a small gap is defined therebetween and such that slip form assemblies 118, 120, 122 extend substantially continuously along the entire perimeter of concrete wall 101 to inhibit concrete poured into cavity 112 from escaping between slip form assemblies 118, 120, 122. In alternative embodiments, slip form construction system 100 includes additional features positioned between forms 108, 110 of adjacent slip form assemblies 118, 120, 122. For example, and without limitation, as shown in FIG. 9, in some alternative embodiments, a roller assembly 301 is coupled between ends 324, 358 of forms 310 of adjacent slip form assemblies 318, 320.

In the exemplary embodiment, inner form 108 and outer form 110 of each slip form assembly 118, 120, 122 are moveable about their respective lifting poles 104 in the longitudinal direction 106 to facilitate moving forms 108, 110 of each slip form assembly 118, 120, 122 relative to adjacent forms 108, 110, and more particularly, relative to adjacent ends 124, 126 of adjacent forms 108, 110, of adjacent slip form assemblies 118, 120, 122. For example, in the exemplary embodiment, first slip form assembly 118 is longitudinally raised (e.g., approximately 8 inches) relative to second slip form assembly 120 and third slip form assembly 122. In the raised position, first end 124 of outer form 110 of first slip form assembly 118 is, at positioned adjacent to, and extends above, second end 126 of outer form 110 of second slip form assembly 120. Likewise, second end 126 of outer form 110 of first slip form assembly 118 is positioned adjacent to, and extends above, first end 124 of outer form 110 of third slip form assembly 122.

During operation (i.e., construction of concrete wall 101), concrete is incrementally poured into cavity 112 from a pouring device (not shown) situated above forms 108, 110. As the poured concrete hardens within cavity 112, inner form 108 and outer form 110 of each slip form assembly 118, 120, 122 are moved vertically in the longitudinal direction 106 to expose hardened portions of concrete wall 101 below forms 108, 110, and to receive additional moldable concrete on top of concrete wall 101 to progressively build up concrete wall 101. In particular, in the exemplary embodiment, slip form assemblies 102 may be raised independently of one another to facilitate lifting the individual slip form assemblies 102 based on a localized hardening state of concrete previously poured within cavities 112 of the respective slip form assembly 118, 120, 122.

Figure 3:
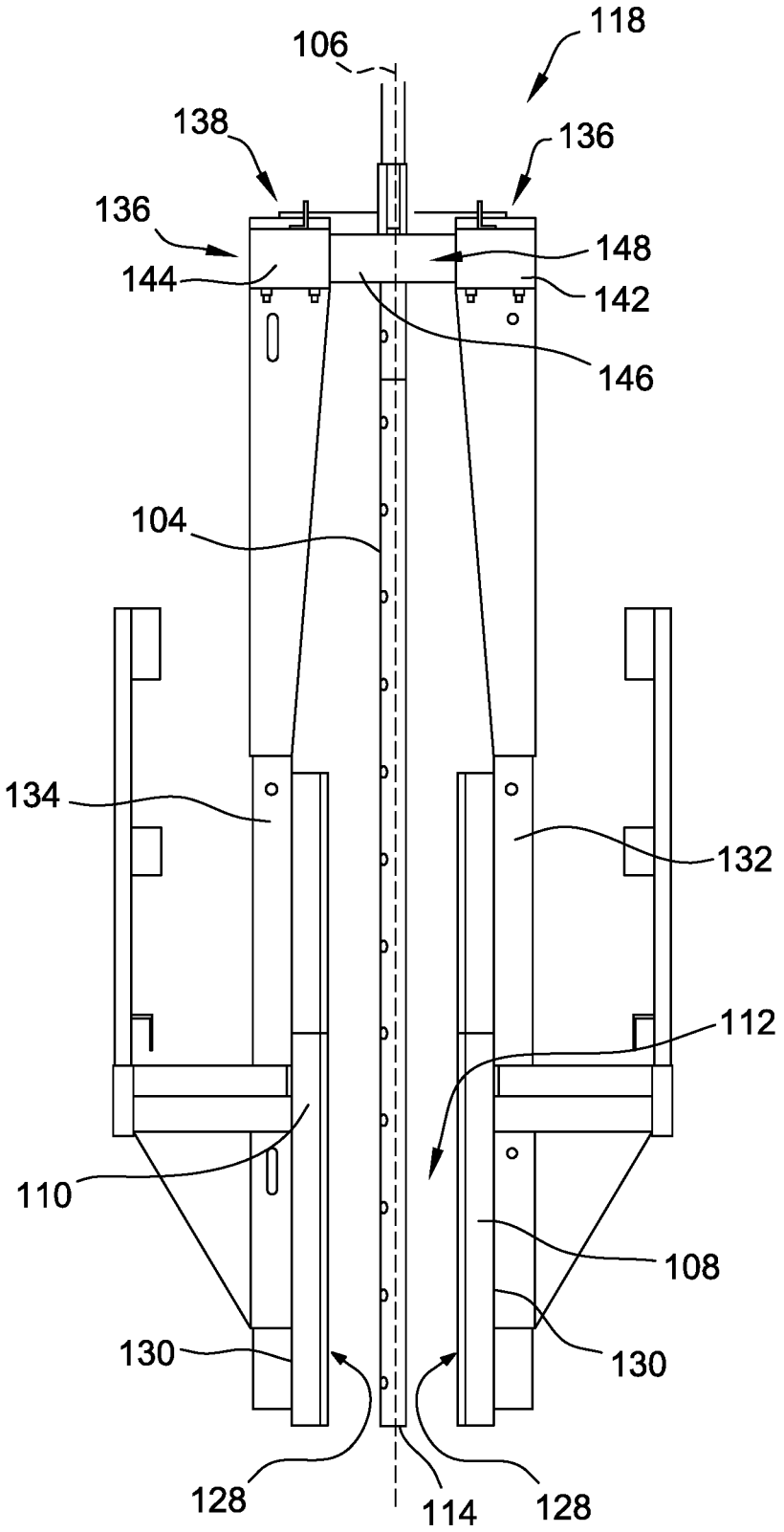
FIG. 3 is a schematic, end view of the first slip form assembly shown in FIG. 2.

FIG. 3 is a schematic, end view of first slip form assembly 118 shown in FIG. 2. In the exemplary embodiment, forms 108, 110 each extend between respective inner surfaces 128 oriented to face one another, and opposed outer surfaces 130. In the exemplary embodiment, slip form assembly 118 includes an inner yoke 132 fixedly coupled to outer surface 130 of inner form 108. Inner yoke 132 extends vertically from outer surface 130 of inner form 108 in the longitudinal direction 106. First slip form assembly 118 further includes an outer yoke 134 fixedly coupled to outer surface 130 of outer form 110. Outer yoke 134 extends vertically from outer surface 130 of outer form 110 in the longitudinal direction 106 parallel to inner yoke 132. In alternative embodiments, inner yoke 132 and outer yoke 134 are coupled to inner form 108 and outer form 110 respectively in any manner that enabled first slip form assembly 118 to function as described herein.

In the exemplary embodiment, first slip form assembly 118 further includes a spreader assembly 136 coupled to inner yoke 132 and outer yoke 134 and extending therebetween in a direction substantially perpendicular to the longitudinal direction. In particular, in the exemplary embodiment, first slip form assembly 118 includes a spreader assembly 136 coupled to inner yoke 132 and outer yoke 134 at respective upper free ends 138 of inner yoke 132 and outer yoke 134. In alternative embodiments, first slip form assembly 118 may include any number of spreader assemblies 136 that enable first slip form assembly 118 to function as described herein. For example, and without limitation, in some alternative embodiments, first slip form assembly 118 includes a third spreader assembly (not shown) fixedly coupled to inner yoke 132 and outer yoke 134 adjacent inner form 108 and outer form 110 respectively.

In the exemplary embodiment, spreader assembly 136 includes an inner bracket 142 fixedly coupled to inner yoke 132, an outer bracket 144 fixedly coupled to outer yoke 134, and a spreader bar 146 fixedly coupled to inner bracket 142 and outer bracket 144 and sized to extend therebetween. In the exemplary embodiment, spreader assembly 136 is configured to engage inner yoke 132 and outer yoke 134 to retain inner form 108 and outer form 110 at a substantially constant distance from one another to facilitate maintaining a substantially uniform width of concrete wall 101 (shown in FIG. 2) during construction. In addition, in the exemplary embodiment, spreader bars 146 are selectively removable from brackets 142, 144 to facilitate coupling, for example, spreader bars 146 of differing lengths to brackets 142, 144 to facilitate forming concrete walls of differing sizes (e.g., forming other concrete walls and/or portions of concrete wall 101 (not shown) having larger and/or smaller widths and thereby requiring greater or lesser spacing between inner forms 108 and outer forms 110). In the exemplary embodiment, spreader bars 146 each define an opening 148 sized to receive a portion of lifting pole 104 extending therethrough.

In the exemplary embodiment, lifting pole 104 extends through a first opening 148 defined in spreader assembly 136. In the exemplary embodiment, lifting pole 104 is configured to be selectively mounted to foundation 114 (shown in FIG. 2) to maintain extension of lifting pole 104 in the longitudinal direction 106. More specifically, lifting pole 104 is configured to vertically guide first slip form assembly 118 during construction of concrete wall 101 (shown in FIG. 1).

In alternative embodiments, first slip form assembly 118 includes a work platform coupled to at least one of inner yoke 132 and outer yoke 134. For example, and without limitation, in such embodiments, the work platforms are positioned along one of inner yoke 132 and outer yoke 134 to enable operators to work on concrete freshly poured into cavity 112 (e.g., smoothing/vibrating freshly poured concrete). In further alternative embodiments, the work platforms extend continuously between slip form assemblies 102 (shown in FIG. 1) such that operators may traverse the entire perimeter of concrete wall 101 on the work platforms. In such embodiments, a gap (not shown) is defined between the work platforms of adjacent slip form assemblies 102 (shown in FIG. 1) to facilitate independent longitudinal movement of forms 108, 110 relative to one another. In further alternative embodiments, the work platforms (not shown) of adjacent slip form assemblies 102 (shown in FIG. 1) are hingedly coupled to one another. In yet further alternative embodiments, the work platforms may be coupled to first slip form assembly 118 in any manner that enables the work platforms to function as described herein. In yet further embodiments, powered lifts e.g., telehandlers, are used to position crews relative to concrete wall 101 (shown in FIG. 2) during construction.

Figure 4:
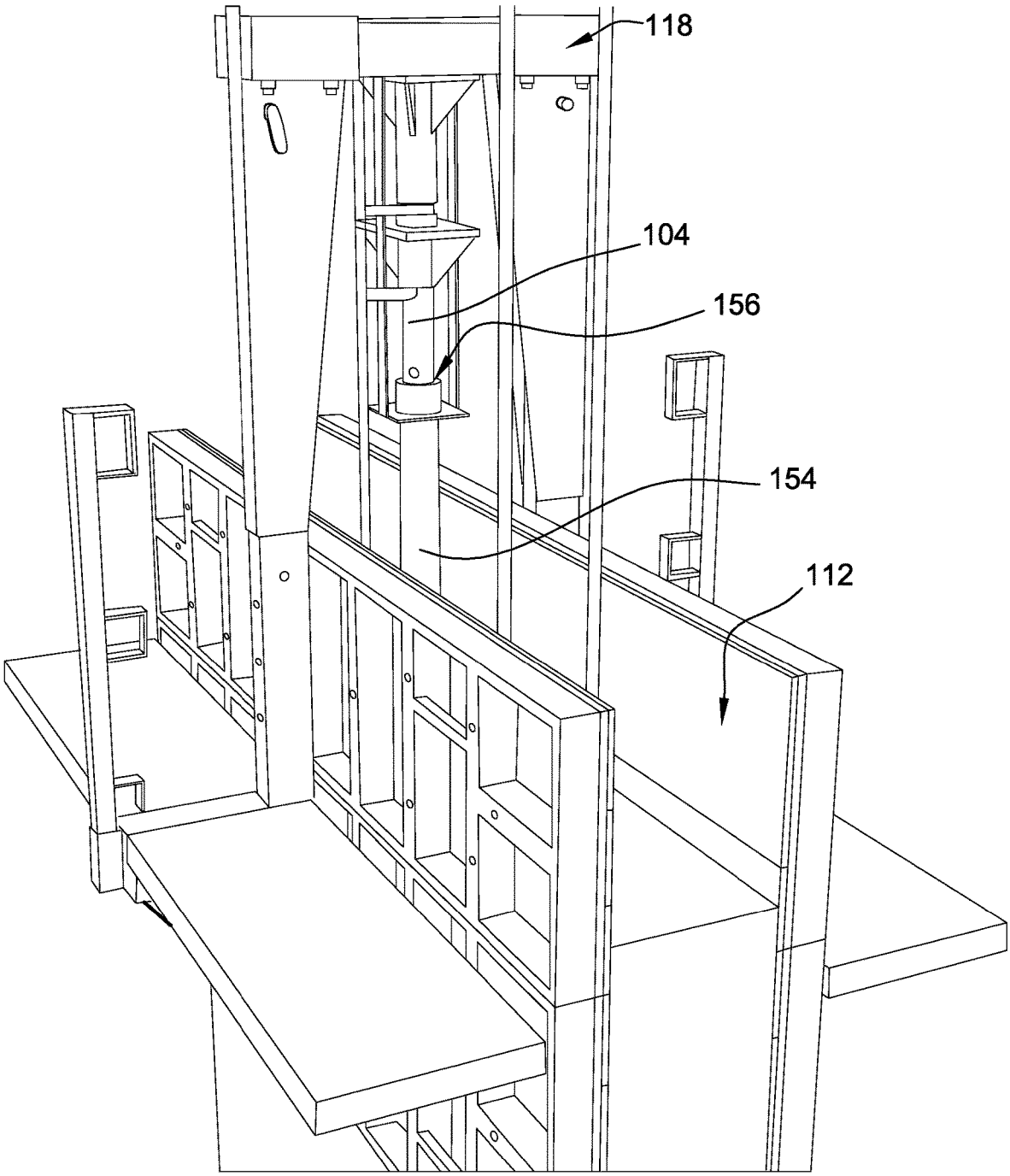
FIG. 4 is schematic, perspective view of a portion of the slip form assembly shown in FIG. 3.

FIG. 4 is schematic, perspective view of a portion of first slip form assembly 118 shown in FIG. 3. In the exemplary embodiment, first slip form assembly 118 includes a shielding sleeve 154 configured to surround at least a portion of lifting pole 104 to inhibit poured concrete from hardening around lifting pole 104. More specifically, shielding sleeve 154 is substantially hollow and defines a channel 156 sized to receive at least a portion of lifting pole 104 therein. During construction of concrete wall 101 (shown in FIG. 1), shielding sleeve 154 is located at the base of lifting pole 104. As concrete is poured into cavity 112, shielding sleeve 154 inhibits concrete from coming into contact with lifting pole 104. As concrete hardens and first slip form assembly 118 is raised, shielding sleeve 154 is raised in the longitudinal direction in correspondence with first slip form assembly 118, thereby shielding portions of lifting pole 104 as they are freshly exposed to poured concrete and revealing a cavity (not shown) between lifting pole 104 and hardened concrete below shielding sleeve 154. At least in part due to the cavity formed between lifting pole 104 and hardened concrete as a result of shielding sleeve 154, lifting pole 104 is selectively removable from concrete wall 101 (shown in FIG. 1), for example, after concrete wall 101 is constructed. In the exemplary embodiment, shielding sleeve 154 is formed of polyvinyl chloride (PVC). In alternative embodiments, shielding sleeve 154 is formed of any material that enables shielding sleeve 154 to function as described herein.

Figure 5:
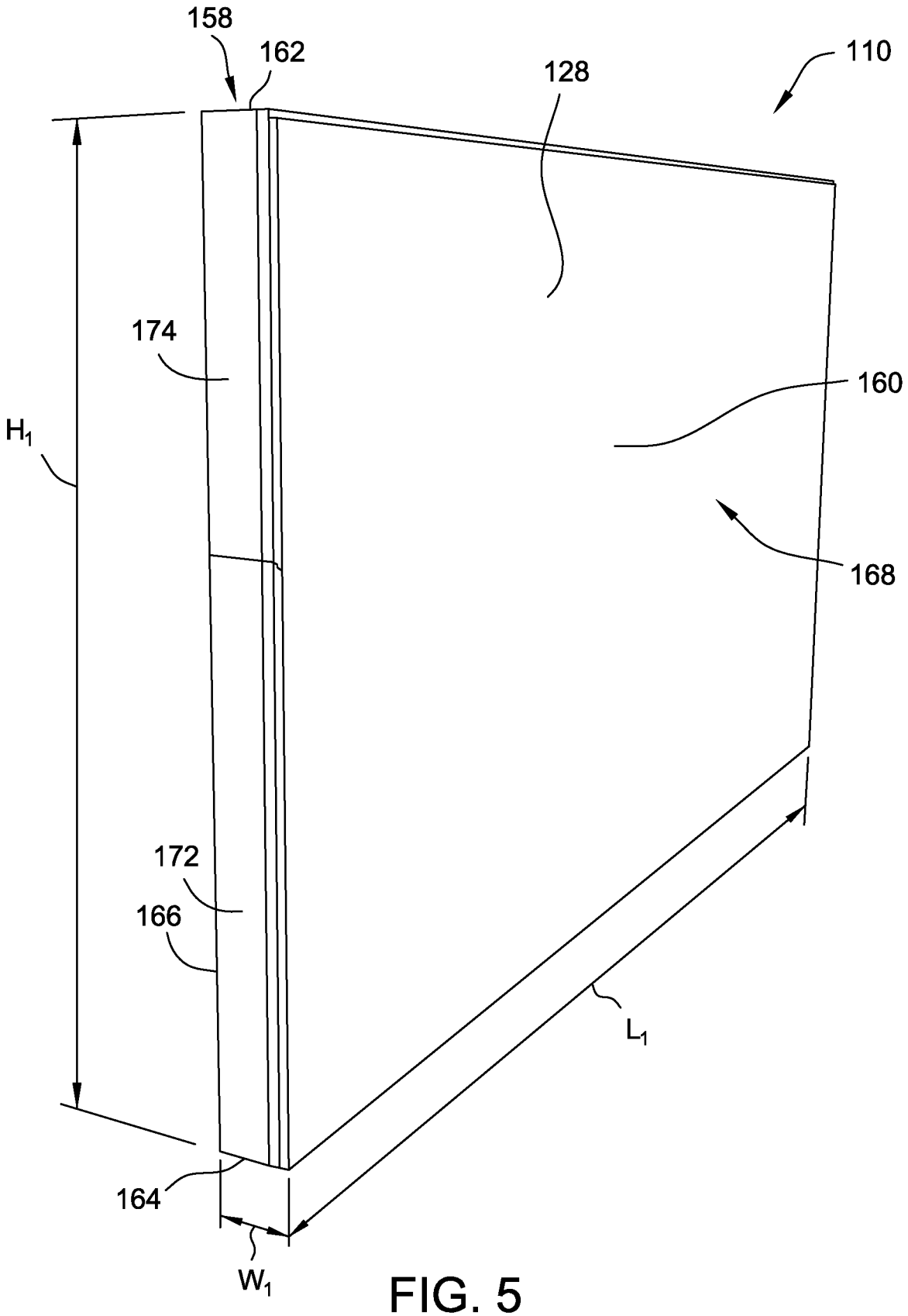
FIG. 5 is a schematic, perspective view of an outer form for use in the slip form assembly shown in FIG. 3.

FIG. 5 is a schematic, perspective view of outer form 110 for use in first slip form assembly 118 shown in FIG. 3. In the exemplary embodiment, outer form 110 includes a form body 158 and a surface panel 160 coupled to form body 158. Outer form 110 includes a top 162, a bottom 164 opposite top 162, a first side 166, and a second side 168 opposite first side 166. Second side 168 includes inner surface 128. Inner surface 128 is configured to face cavity 112 (shown in FIG. 1) and form concrete poured into cavity 112. Outer form 110 extends a height, generally indicated at H1 between top 162 and bottom 164. Outer form 110 extends a width, indicated generally at W1, between first side 166 and second side 168. In the exemplary embodiment, height H1 of outer form 110 is approximately five feet, width W1 of outer form 110 is 4.75 inches, and length L1 of outer form 110 is approximately 9 feet. In alternative embodiments, outer form 110 is sized in any manner that enables first slip form assembly 118 (shown in FIG. 5) to function as described herein.

In the exemplary embodiment, surface panel 160 defines inner surface 128 of outer form 110. More specifically in the exemplary embodiment, surface panel 160 extends along the entire second side 168 of outer form 110 such that, during operation, surface panel 160 directly contacts concrete poured into cavity 112 (shown in FIG. 4). As a result, surface panels 160 prevent concrete poured into cavity 112 from contacting forms 108 (shown in FIG. 1) and/or 110. As such, surface panels 160 facilitate extending the useful life of forms 108 (shown in FIG. 1) and 110.

In the exemplary embodiment, each stacked panel 161 is formed of a material having a low coefficient of friction with concrete to facilitate slidably moving forms 108 and 110 in the longitudinal direction relative to poured and hardened concrete during operation. The material in stacked panels 161 not only has a low coefficient of friction with concrete, but also has high abrasion resistance, impact resistance, and wear resistance qualities, such as for example, relative to hardened concrete. In addition, the material used in fabricating stacked panels 161 is corrosion-resistant and highly durable. In particular, in the exemplary embodiment, each stacked panel 161 is formed of an ultra-high molecular weight ("UHMW") polyethylene. In other embodiments, stacked panels 161 may be formed of any other material that enables stacked panels 161 to function as described herein. For example, in some embodiments, stacked panels 161 may be fabricated from a linear low-density polyethylene (LLDPE) material blend, a low-density polyethylene (LDPE) material blend, and/or a LLDPE/LDPE blend. In other embodiments, stacked panels 161 may be fabricated from a material including acetate, acetal, polyester, urethane, ethylene-vinylacetate (EVA), polypropylene, high density polyethylene, thermoplastic elastomer (TPE) and/or any combination of such materials. In some embodiments, stacked panels 161 may be fabricated from any other suitable material including, but not limited to polyethylene (such as LDPE, LLDPE, HDPE, UHMW, or the like), Acrylonitrile Butadiene Styrene (ABS), polycarbonate, glass fiber reinforced polyester (GRP), polypropylene, or any combination thereof.

In some embodiments, the material used in fabricating surface panels 160 may include a material that is ultraviolet (UV) stabilized, UV inhibited, and/or UV resistant to prevent UV degradation. In some so such embodiments, the material used in fabricating surface panels 160 may be inherently UV stable, while in other embodiments, a chemical, a coating, or a film may be added to the material to produce such effects.

In the exemplary embodiment, form body 158 includes a first form panel 172 and a second form panel 174 coupled to and positioned above first form panel 172. In particular, in the exemplary embodiment, a coupling mechanism, e.g., a clamp (not shown), engages first form panel 172 and second form panel 174 to maintain first form panel 172 and second form panel 174 as a rigid unit. In alternative embodiments, first form panel 172 and second form panel 174 are coupled in any manner that enables outer form 110 to function as described herein. In the exemplary embodiment, first form panel 172 and second form panel 174 are adjacent to surface panel 160. In the exemplary embodiment, surface panel 160 is not attached or coupled to form panels 172 and/or 174. In alternative embodiments, outer form 110 does not include second form panel 174. For example, and without limitation, in some such embodiments, first form panel 172 extends the entire height of surface panel 160. While the description herein is directed to outer form 110, it will be understood that inner form 108 (shown in FIG. 3) of first slip form assembly 118 may be constructed in substantially the same manner described with respect to outer form 110.

Figure 6:
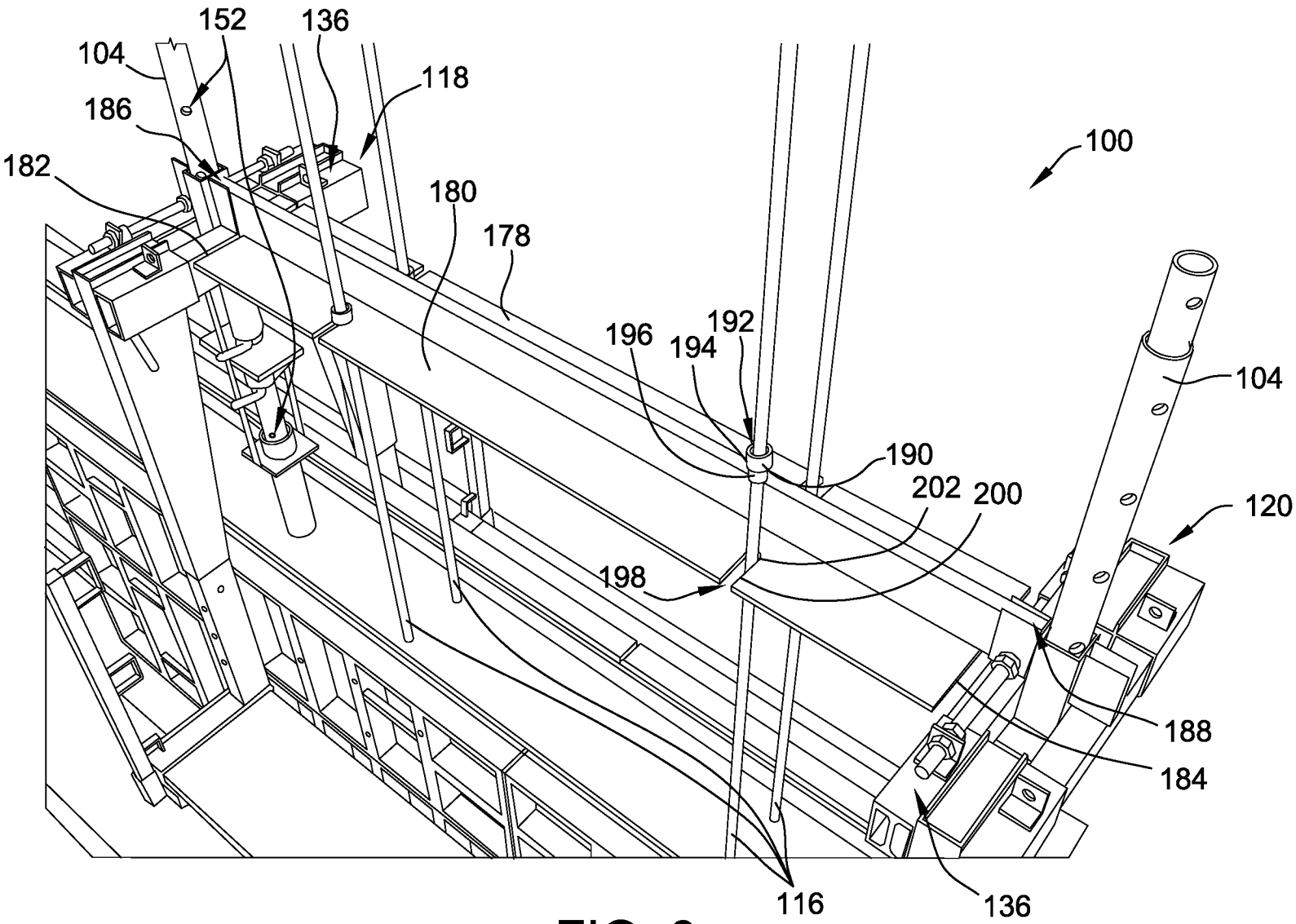
FIG. 6 is a schematic, perspective view of a portion of the slip form construction system shown in FIG. 1.

FIG. 6 is a schematic, perspective view of a portion of slip form construction system 100 shown in FIG. 1. In the exemplary embodiment slip form construction system 100 includes a reinforcing bar template 178 extending between first slip form assembly 118 and second slip form assembly 120. More specifically, in the exemplary embodiment, reinforcing bar template 178 includes a body 180 extending between a first end 182, resting on and supported by spreader assembly 136 of first slip form assembly 118, to a second end 184, resting on and supported by spreader assembly 136 of second slip form assembly 120. In the exemplary embodiment, first end 182 defines a first projection 186 and second end 184 defines a second projection 188. First projection 186 and second projection 188 are each sized to receive at least a portion of respective lifting poles 104 therein to maintain reinforcing bar template 178 in position with respect to first slip form assembly 118 and second slip form assembly 120 and to facilitate slidably moving reinforcing bar template 178 along lifting poles 104 during operation.

In the exemplary embodiment, reinforcing bars 116 are each slidably received within a bushing 190. In the exemplary embodiment, bushings 190 are generally tubular shape and define a passageway 192 sized to slidably receive reinforcing bars 116 therein. Bushings 190 each include a first circumferential section 194 and a narrower, second circumferential section 196 positioned axially adjacent first circumferential section 194 and sized to have a smaller outer diameter than first circumferential section 194. First circumferential section 194 is coupled to second circumferential section 196 such that passageway 192 extends through each of first circumferential section 194 and second circumferential section 196.

In the exemplary embodiment, body 180 defines a plurality of guide notches 198 between first end 182 and second end 184. Guide notches 198 are each sized to receive a portion of reinforcing bars 116 therein to maintain an even positioning of reinforcing bars 116 relative to one another within wall 101 (shown in FIG. 1) during construction. In particular, in the exemplary embodiment, guide notches 198 each include a channel portion 200 extending to a slot portion 202. Channel portion 200 is sized to receive reinforcing bars 116 therein. More specifically, channel portion 200 is sized to allow a longitudinally extending reinforcing bar 116 to be inserted transversely through channel portion 200 and into slot portion 202. In the exemplary embodiment, reinforcing bar template 178 defines four guide notches 198 each receiving one reinforcing bars 116 therein. In alternative embodiments, reinforcing bar template 178 defines any number of guide notches 198 that enable reinforcing bar template 178 to function as described herein.

In the exemplary embodiment, slot portion 202 is sized to axially receive second circumferential section 196 of bushing 190 and to inhibit axial insertion of first circumferential section 194 therein. In particular, in the exemplary embodiment, slot portion 202 has a smaller circumference than first circumferential section 194 such that, when second circumferential section 196 is axially inserted into slot portion 202, body 180 engages and supports first circumferential section 194. Furthermore, channel portion 200 is sized to inhibit transverse movement of second circumferential section 196 therein. More specifically, in the exemplary embodiment, channel portion 200 has a width that is less than an outer diameter of second circumferential section 196 such that, when second circumferential section 196 is axially inserted into slot portion 202, transverse movement of reinforcing bar 116 and bushing 190 into channel portion 200 is prevented.

During operation, as first slip form assembly 118 and second slip form assembly 120 are longitudinally moved relative to reinforcing bars 116, reinforcing bar template 178 is likewise moved in the longitudinal direction. In the exemplary embodiment, the engagement between body 180 and first circumferential section 194 drives slidable movement of bushing 190 along reinforcing bar 116 as reinforcing bar template 178 is lifted.

In the exemplary embodiment, lifting pole 104 is substantially hollow and defines a plurality of apertures 152 equidistantly spaced along the length of lifting pole 104. More specifically, in the exemplary embodiment, apertures 152 each include a corresponding circumferentially opposite aperture (not shown) defined in lifting pole 104 to facilitate pin locking engagement through apertures 152. In the exemplary embodiment, apertures 152 are each spaced approximately 8 inches apart from each of the closest longitudinal apertures 152. In alternative embodiments, apertures 152 are spaced from one another any distance that enables slip form assemblies 102 to function as described herein.

Figure 7:
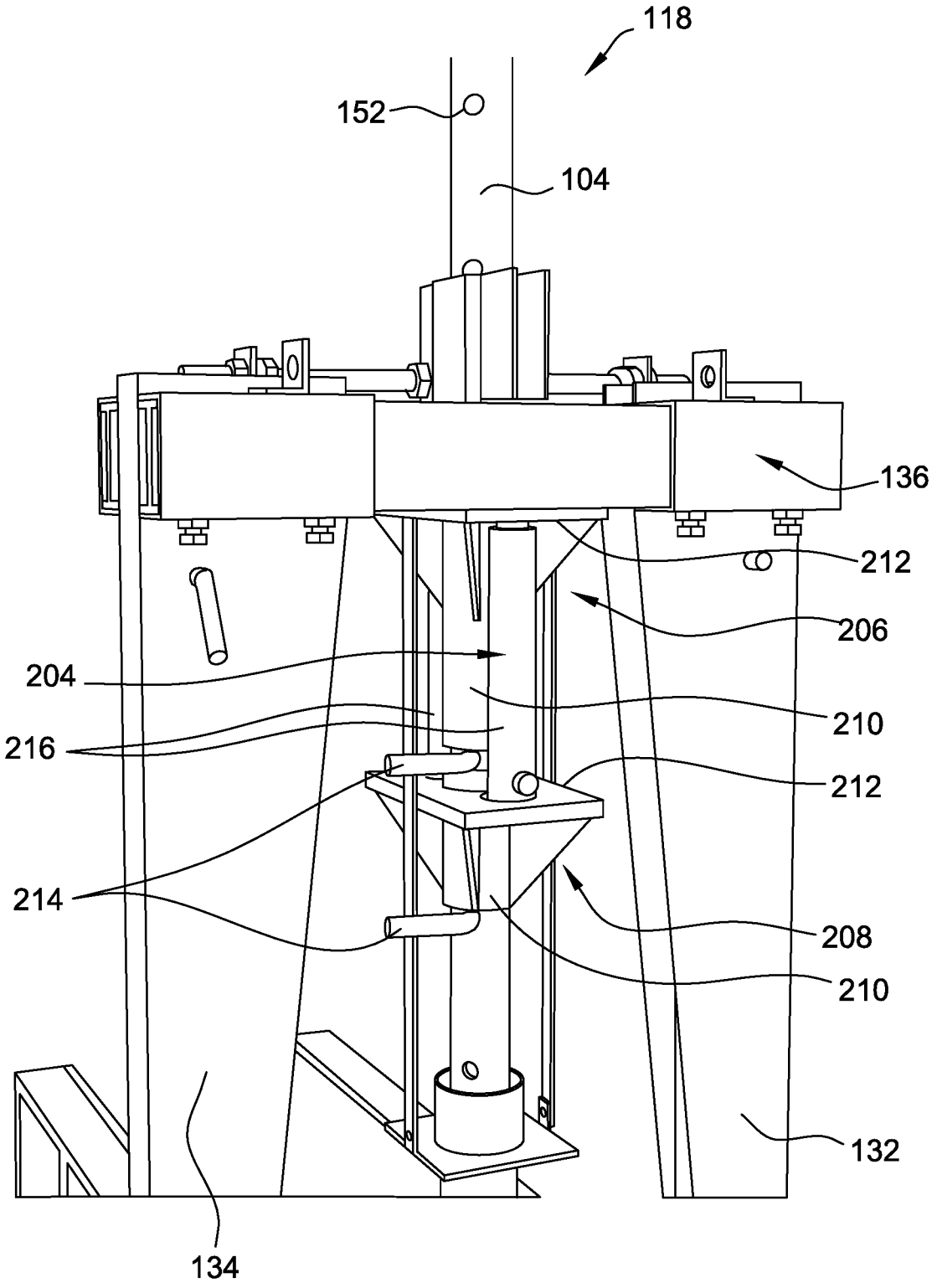
FIG. 7 is a schematic, perspective view of a portion of the slip form assembly shown in FIG. 3 including a lifting mechanism in a retracted position.
Figure 8:
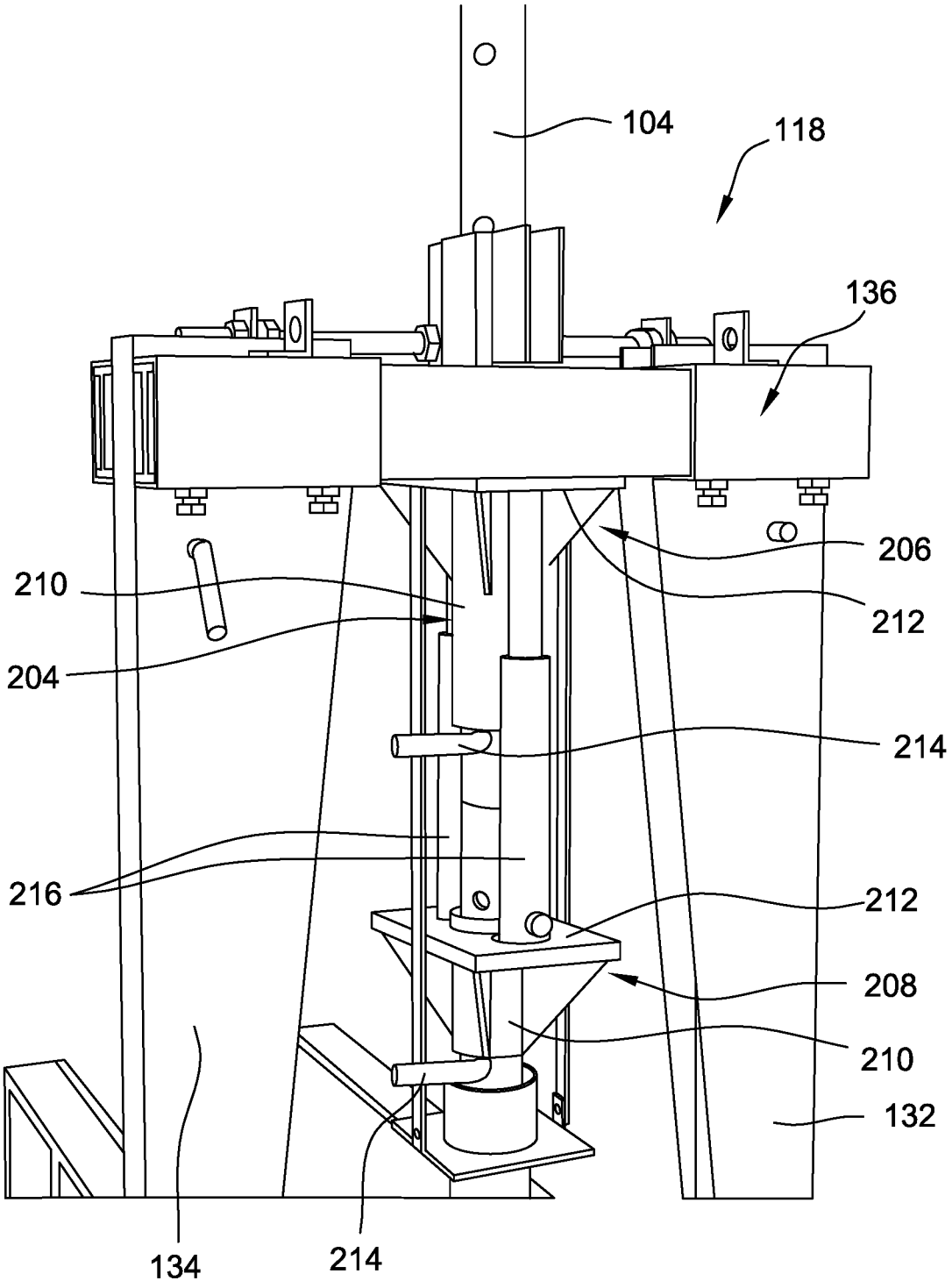
FIG. 8 is a schematic, perspective view of the portion of the slip form assembly shown in FIG. 7 with the lifting mechanism in an extended position.

FIG. 7 is a schematic, perspective view of a portion of first slip form assembly 118 shown in FIG. 3 including a lift mechanism 204 in a retracted position. FIG. 8 is a schematic, perspective view of the portion of first slip form assembly 118 shown in FIG. 7 with lift mechanism 204 in an extended position.

In the exemplary embodiment, first slip form assembly 118 includes a first support assembly 206, a second support assembly 208, and lift mechanism 204 coupled to first support assembly 206 and second support assembly 208. In the exemplary embodiment, first support assembly 206 is slidably coupled to lifting pole 104 and is configured to support spreader assembly 136 on lifting pole 104. More specifically, in the exemplary embodiment, first support assembly 206 includes a sleeve portion 210 sized to slidably receive lifting pole 104 therein and a lifting plate 212 coupled to sleeve portion 210 and sized to engage and support spreader assembly 136 on lifting pole 104. In the exemplary embodiment, first support assembly 206 further includes a pin key 214 configured to support sleeve portion 210 longitudinally relative to lifting pole 104.

In the exemplary embodiment, second support assembly 208 includes substantially the same configuration as first support assembly 206. For example, in the exemplary embodiment, second support assembly 208 includes a lifting plate 212 coupled to a sleeve portion 210. Second support assembly 208 is coupled to lifting pole 104 via an additional pin key 214 longitudinally below second support assembly 208 to facilitate supporting lift mechanism 204 between first support assembly 206 and second support assembly 208.

In the exemplary embodiment, lift mechanism 204 is configured to drive longitudinal movement of first support assembly 206 along lifting pole 104 relative to second support assembly 208. More specifically, in the exemplary embodiment, lift mechanism 204 includes two jacks 216 supported on lifting plate 212 of second support assembly 208. Jacks 216 are extendable between a retracted position (shown in FIG. 7) and an extended position (shown in FIG. 8) and are configured to engage lifting plate 212 of first support assembly 206 and be moved into the extended position (shown in FIG. 8) to drive longitudinal movement of first support assembly 206 along lifting pole, and thereby, drive longitudinal movement of spreader assembly 136, yokes 132, 134, and forms 108, 110 (shown in FIG. 3) along lifting pole 104. In the exemplary embodiment, jacks 216 are hydraulically actuated. In alternative embodiment, jacks are pneumatically actuated. In another alternative embodiment, mechanical screw jacks are used. In yet further alternative embodiments, lift mechanism 204 includes any lifting device that enables first slip form assembly 118 to function as described herein.

Referring to FIG. 8, during operation, when lift mechanism 204 is in the extended position, pin key 214 is moved to a longitudinally adjacent aperture to couple first support assembly 206 to lifting pole 104 in the extended position. After coupling first support assembly 206 to lifting pole 104, lift mechanism 204 is lowered and removed from second support assembly 208. Lift mechanism 204 is then positioned on second support assemblies of adjacent slip form assemblies 102 (shown in FIG. 1) to facilitate lifting adjacent slip form assemblies 102. Accordingly, in the exemplary embodiment, a single lift mechanism 204 is used to lift each first slip form assembly 118 of slip form construction system 100 (shown in FIG. 1). In other embodiments, each first slip form assembly 118 includes a respective lift mechanism 204. In further alternative embodiments, slip form construction system 100 (shown in FIG. 1) includes any number of lift mechanisms 204 that enable slip form construction system 100 (shown in FIG. 1) to function as described herein.

Figure 10:
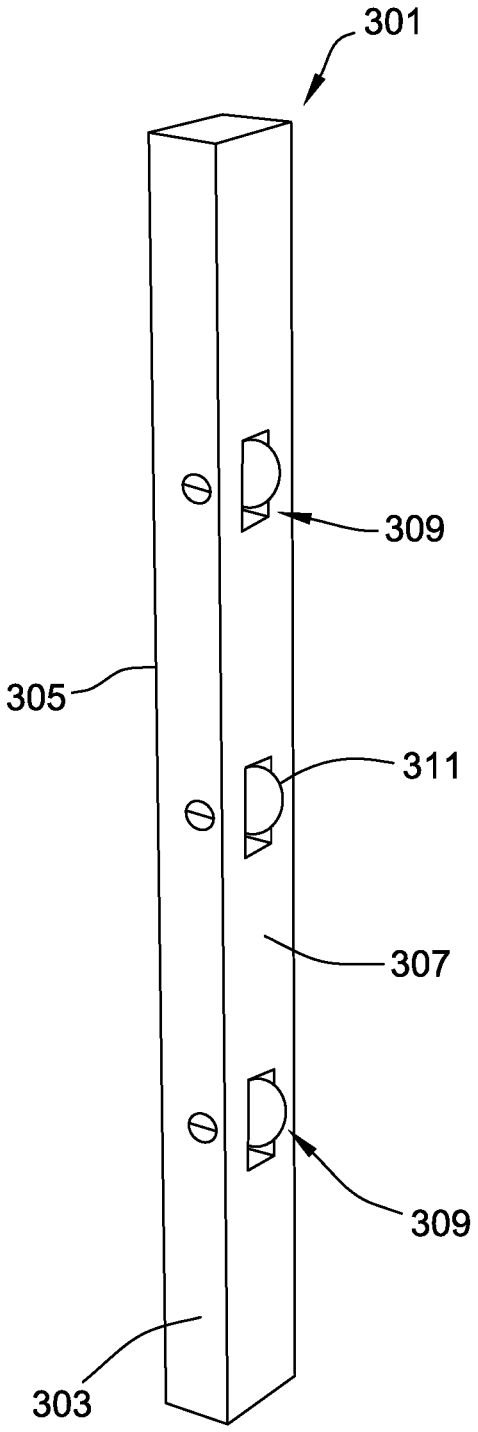
FIG. 10 is a schematic, perspective view of a roller assembly for use in the slip form assembly shown in FIG. 9.

FIG. 9 is a schematic, perspective view of a portion of an alternative slip form assembly 318 for use in the slip form construction system 100 shown in FIG. 1. FIG. 10 is a schematic, perspective view of a roller assembly 301 for use in slip form construction assembly 318 shown in FIG. 9. First slip form assembly 318 is substantially the same as first slip form assembly 118 described above with respect to FIGS. 1-8 except that, in the exemplary embodiment, first slip form assembly 318 includes an outer form 310 having roller assembly 301. In the exemplary embodiment, inner form 308 of first slip form assembly includes roller assembly 301 configured in substantially the same manner as roller assembly 301 of outer form 310 described below.

In the exemplary embodiment, outer form 310 of first slip form assembly 318 extends to a second end 326 defined by roller assembly 301. In other words, in the exemplary embodiment, a planar end face (not shown) of roller assembly 301 defines second end 326 of outer form 310 of first slip form assembly 318. An outer form 310 of a second slip form assembly 320 is positioned adjacent outer form 310 of first slip form assembly 318 in close proximity to second end 326 of outer form 310 of first slip form assembly 318 or, more specifically, with roller assembly 301. In particular, in the exemplary embodiment, roller assembly 301 is coupled to a form body 358 of first slip form assembly 318 and is positioned to extend from form body 358 and abut a first end 324 of outer form 310 of second slip form assembly 320. In alternative embodiments, roller assembly 301 is coupled to form body 358 in any manner that enables roller assembly 301 to function as described herein.

Roller assembly 301 is configured to reduce friction between forms 310 when slip form assemblies 318, 320 are raised relative to one another. In particular, referring to FIG. 10, in the exemplary embodiment, roller assembly 301 includes a housing 303 having a first side 305 configured to be coupled to form. Housing 303 also includes a second side 307, opposite first side 305, configured to face an end of an opposing form (e.g., outer form 310 of second slip form assembly 320 (shown in FIG. 9)). Housing 303 defines recesses 309 in second side 307 each partially containing a rolling element 311 therein. In the exemplary embodiment, rolling elements 311 are wheels configured to rotate about an axel (not shown) positioned within housing 303. Rolling elements 311 are longitudinally along second side 307 to facilitate rolling engagement with an opposing form at multiple points along the length of roller assembly 301. In alternative embodiments, rolling elements 311 cover the entire length of roller assembly 301 such that roller assembly 301 is configured to only contact an opposing form via rolling elements 311. In further alternative embodiments, rolling elements are arranged on housing 303 in any manner that enables roller assembly 301 to function as described herein.

Referring back to FIG. 9, in the exemplary embodiment, a surface panel 360 is coupled to roller assembly 301 on a second side (similar to second side 168 of outer form 110 shown in FIG. 5) of outer form 310. In the exemplary embodiment, during operation, rolling elements 311 do not substantially come into contact with concrete poured into the cavity 112 (shown in FIG. 4) but rather are at least partially shielded from concrete by the surface panel (not shown) and housing 303. In alternative embodiments, rolling elements 311 are shielded from the poured concrete in any manner that enables roller assembly 301 to function as described herein.

Figure 11:
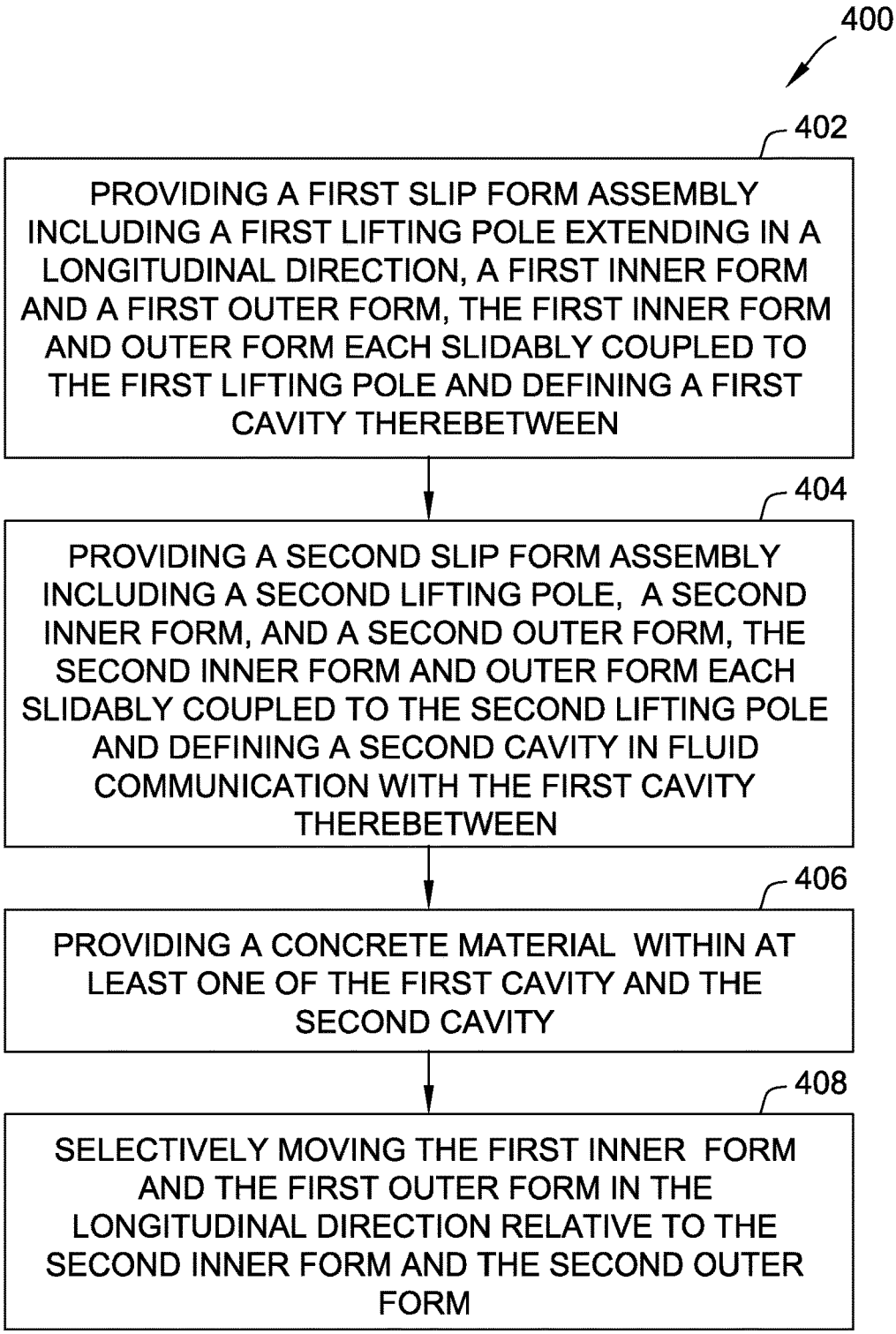
FIG. 11 is a flow diagram of an exemplary method of assembling a concrete wall.

FIG. 11 is a flow diagram of an exemplary method 400 of assembling a concrete wall (e.g., concrete wall 101 shown in FIG. 1). Method 400 includes providing 402 a first slip form assembly (e.g., first slip form assembly 118 shown in FIG. 2) including a first lifting pole (e.g., lifting pole 104 shown in FIG. 2) extending in a longitudinal direction, a first inner form (e.g., inner form 108 shown in FIG. 2), and a first outer form (e.g., outer form 110 shown in FIG. 2), the first inner form and outer form each slidably coupled to the first lifting pole and defining a first cavity (e.g., cavity 112 shown in FIG. 2) therebetween. Method 400 also includes providing 404 a second slip form assembly (e.g., second slip form assembly 120 shown in FIG. 2) including a second lifting pole, a second inner form, and a second outer form, the second inner form and second outer form each slidably coupled to the second lifting pole and defining a second cavity (e.g., cavity 112 shown in FIG. 2) in fluid communication with the first cavity therebetween. Method 400 further includes providing 406 a concrete material within at least one of the first cavity and the second cavity and selectively moving 408 the first inner form and the first outer form in the longitudinal direction relative to the second inner form and the second outer form.

Figure 12:
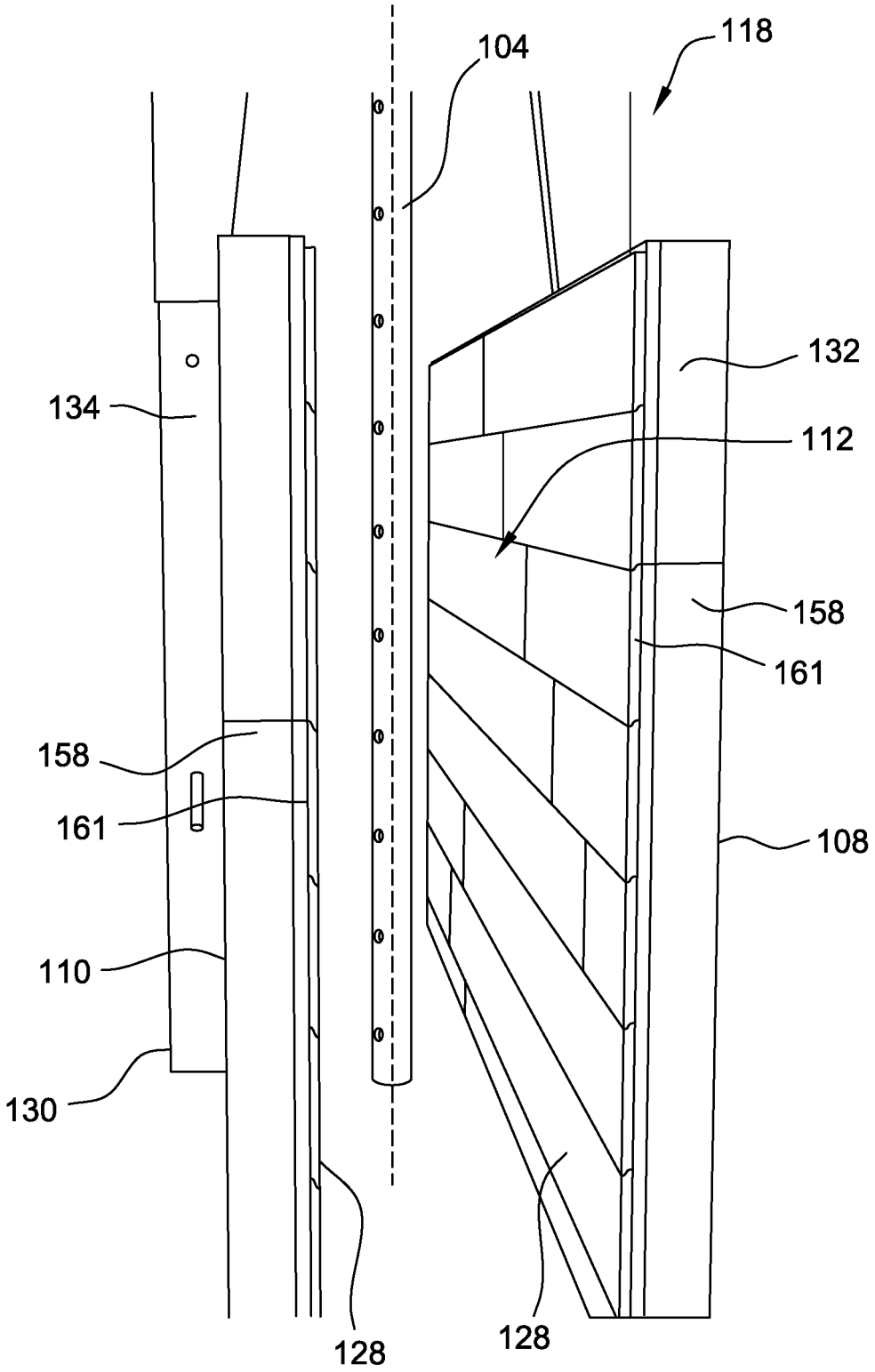
FIG. 12 is an enlarged schematic, end view of an alternative slip form assembly for use in the slip form construction system shown in FIG. 1.

FIG. 12 is an enlarged schematic, end view of an alternative slip form assembly 118 for use in slip form construction system 100 shown in FIG. 1. In the exemplary embodiment, slip form assembly 118 is substantially identical to first slip form assembly 118, described above with respect to FIG. 3, except as described below. In particular, in the exemplary embodiment of FIG. 12, slip form assembly 118 includes a plurality of stacked panels 161 positioned in contact with form bodies 158 of inner form 108 and outer form 110. Stacked panels 161 are similar to surface panels 160 (shown in FIG. 5, for example) and when positioned, define respective inner surfaces 128 of inner form 108 and outer form 110, such that a cavity 112 is defined between the stacked panels 161 defining an inner surface 128 for inner form 108 and those stacked panels 161 defining an inner surface 128 for outer form 110. As such, stacked panels 161 are configured to engage concrete poured between forms 108 and 110 within cavity 112. As such, stacked panels 161 facilitate extending the useful life of forms 108 and 110. In the exemplary embodiment, stacked panels 161 are formed of an ultra-high molecular weight ("UHMW") polyethylene. In alternative embodiments, stacked panels 161 are formed of any material that enables slip form assembly 118 to function as described herein.

In the exemplary embodiment, each stacked panel 161 is formed of a material having a low coefficient of friction with concrete to facilitate slidably moving forms 108 and 110 in the longitudinal direction relative to poured and hardened concrete during operation. The material in stacked panels 161 not only has a low coefficient of friction with concrete, but also has high abrasion resistance, impact resistance, and wear resistance qualities, for example, relative to hardened concrete. In addition, the material used in fabricating stacked panels 161 is corrosion-resistant and highly durable. In particular, in the exemplary embodiment, each stacked panel 161 is formed of an ultra-high molecular weight ("UHMW") polyethylene. In other embodiments, stacked panels 161 may be formed of any other material that enables stacked panels 161 to function as described herein. For example, in some embodiments, stacked panels 161 may be fabricated from a linear low-density polyethylene (LLDPE) material blend, a low-density polyethylene (LDPE) material blend, and/or a LLDPE/LDPE blend. In other embodiments, stacked panels 161 may be fabricated from a material including acetate, acetal, polyester, urethane, ethylene-vinylacetate (EVA), polypropylene, high density polyethylene, thermoplastic elastomer (TPE) and/or any combination of such materials. In some embodiments, stacked panels 161 may be fabricated from any other suitable material including, but not limited to polyethylene (such as LDPE, LLDPE, HDPE, UHMW, or the like), Acrylonitrile Butadiene Styrene (ABS), polycarbonate, glass fiber reinforced polyester (GRP), polypropylene, or any combination thereof.

In some embodiments, the material used in fabricating stacked panels 161 may include a material that is ultraviolet (UV) stabilized, UV inhibited, and/or UV resistant to prevent UV degradation. In some of such embodiments, the material used in fabricating stacked panels 161 may be inherently UV stable, while in other embodiments, a chemical, a coating, or a film may be added to the material to produce such effects.

In the exemplary embodiment, unlike first slip form assembly 118 described above with respect to FIG. 3, slip form assembly 118 does not include a unitary panel (e.g., surface panel 160, shown in FIG. 5) fixably coupled to and covering the height of form bodies 158. Rather, in the exemplary embodiment, stacked panels 161 are configured to directly contact form bodies 158 and are configured to facilitate longitudinal movement of form bodies 158 relative to stacked panels 161. Moreover, in the exemplary embodiment, stacked panels 161 each extend only a portion of the height of form bodies 158. In particular, in the exemplary embodiment, stacked panels 161 each extend a height of approximately 8 inches. In alternative embodiments, stacked panels 161 extend any height that enables stacked panels 161 to function as described herein. In further alternative embodiments, a surface panel (e.g., surface panel 160, shown in FIG. 5) is fixably coupled to form bodies 158 and stacked panels 161 are configured to be positioned between, and in direct contact with, the surface panel and the concrete.

In the exemplary embodiment, stacked panels 161 are each removably coupled to an adjacent stacked panel 161. In particular, stacked panels 161 each include a coupling features (e.g., a latch and a catch, not shown) configured to releasably engage coupling features of an adjacent stacked panel 161 such that stacked panels 161 are collectively supported on form bodies 158 and held-in place during a pouring operation. In alternative embodiments, stacked panels 161 are held in place during a pouring operation in any manner that enables slip form assembly 118 to function as described herein. During operation, prior to beginning an initial pour, an operator may position stacked panels 161 adjacent respective form bodies 158 of inner form 108 and outer form 110. Concrete is then poured in 8-inch increments until the level of concrete reaches near the top level of forms 108, 110. As forms 108, 110 are raised, bottom course of panels 161 of stacked panels 161 are exposed beneath raised forms 108, 110. Bottom course of panels 161 may then be detached from an adjacent stacked panel 161 (e.g., by releasing the coupling features from an adjacent stacked panel 161). A new top stacked panel 161 may also be added on top of the stacked panels 161 to facilitate pouring additional concrete. As a result, stacked panels 161 may be cleaned or replaced prior to being inserted at the top of form body 158 to prevent any hardened concrete remaining on stacked panels 161 from leaving imprints in the hardening concrete. In the exemplary embodiment, stacked panels 161 collectively define a generally planar inner surface 128. In alternative embodiments, stacked panels 161 may be texturized to facilitate forming textured surfaces in the concrete wall 101 (shown in FIG. 1). In the exemplary embodiment, stacked panels 161 are all identical. Alternatively, stacked panels 161 may be different. For example, at least some stacked panels 161 positioned adjacent inner form 108 may be formed with a planar surface, while at least some stacked panels 161 positioned adjacent to outer form 110 may be texturized.

An exemplary technical effect of the methods, systems, and apparatus described herein includes at least one of: (a) improved ease of assembly in constructing concrete structures; (b) reduced downtime required to construct concrete structures; (c) improved accuracy in placing reinforcement members (e.g., reinforcing bars) within concrete structures; (d) improved worker safety during construction; (e) reduced machinery (e.g., a crane) required to construct concrete structure; and (f) reduced overall construction time.

Exemplary embodiments of slip form assemblies, slip form construction systems, and methods for assembling a concrete wall, are described above in detail. The methods and systems are not limited to the specific embodiments described herein, but rather, components of systems and/or steps of the methods may be utilized independently and separately from other components and/or steps described herein. For example, the method may also be used in combination with other slip form assemblies and/or slip form construction systems, and are not limited to practice only with the slip form assemblies and slip form construction systems as described herein. Rather, the exemplary embodiment can be implemented and utilized in connection with many other slip form construction systems.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A slip form assembly for use in a slip form construction system, said slip form assembly comprising:

a lifting pole extending in a longitudinal direction;

an inner form slidably coupled to said lifting pole and extending in a lengthwise direction perpendicular to the longitudinal direction between a first end and a second end;

an outer form slidably coupled to said lifting pole opposite said inner form, said outer form substantially parallel to said inner form and spaced a distance from said inner form such that a cavity is defined therebetween, said outer form extending between a first end and a second end, said inner form and said outer form being moveable along said lifting pole in the longitudinal direction relative to respective ends of an adjacent inner form and an adjacent outer form; and at least one panel coupled to at least one of said inner form and said outer form wherein said at least one panel forms at least a partial inner surface of said at least one of said inner form and said outer form such that said at least one panel engages and contacts concrete poured into said cavity, and remains between the concrete and against said at least one of said inner form and said outer form to which said at least one panel is coupled, said at least one of said inner form and said outer form configured to slidably move in the longitudinal direction relative to said at least one panel such that said at least one panel prevents the concrete poured into said cavity from contacting said at least one of said inner form and said outer form, wherein said at least one of said inner form and said outer form to which said at least one panel is coupled has a height measure along the longitudinal direction, said at least one panel has a height measured along the longitudinal direction that is shorter than said height of said at least one of said inner form and said outer form.

2. The slip form assembly in accordance with claim 1, wherein said at least one panel comprises a plurality of panels, each of said plurality of panels is configured to releasably couple to an adjacent panel of said plurality of panels.

3. The slip form assembly in accordance with claim 2, wherein said plurality of panels are configured to be held-in place and collectively supported on said at least one of said inner form and said outer form during a concrete pouring operation.

4. The slip form assembly in accordance with claim 1, wherein said at least one panel comprises a plurality of identical panels, each of said plurality of identical panels comprises a generally planar inner surface configured to engage the concrete poured into said cavity defined between said inner and outer forms.

5. The slip form assembly in accordance with claim 1, wherein said at least one panel comprises a plurality of panels, wherein at least a first of said plurality of panels comprises a generally planar inner surface configured to engage the concrete poured into said cavity defined between said inner and outer forms, wherein at least a second of said plurality of panels comprises a textured inner surface configured to engage the concrete poured into said cavity defined between said inner and outer forms.

6. The slip form assembly in accordance with claim 1, wherein said at least one panel is formed of a material having a lower coefficient of friction than the concrete such that said at least one panel facilitates slidably moving said at least one of said inner form and said outer form in the longitudinal direction relative to the poured and hardened concrete within said cavity.

7. The slip form assembly in accordance with claim 6, wherein said at least one panel is formed from a polyethylene material.

8. The slip form assembly in accordance with claim 6, wherein said at least one panel is formed of a material having higher abrasion resistance, impact resistance, and wear resistance qualities than the hardened concrete.

9. The slip form assembly in accordance with claim 8, wherein said at least one panel is formed from at least one of a linear polyethylene material (LPE) blend, a polyethylene (PE) material blend, and a LPE/PE material blend.

10. The slip form assembly in accordance with claim 8, wherein said at least one panel is formed from at least one of acetate, acetal, polyester, urethane, ethylenevinyl-acetate (EVA), polypropylene, and thermoplastic elastomer (TPE).

11. The slip form assembly in accordance with claim 8, wherein said at least one panel is formed from a material that is at least one of ultraviolet (UV) stabilized, UV inhibited, and/or UV resistant to facilitate preventing UV degradation.

12. A slip form construction system comprising:

a first slip form assembly comprising:

a first lifting pole extending in a longitudinal direction;

a first inner form slidably coupled to said first lifting pole; and a first outer form slidably coupled to said first lifting pole opposite said first inner form such that a first cavity for casting a first portion of a wall is defined therebetween; and at least one panel is adjacent to at least one of said first inner form and said first outer form such that said at least one panel forms at least a partial inner surface of at least one of said first inner form and said first outer form wherein concrete poured into said first cavity contacts said at least one panel and is prevented from engaging an inner surface of at least one of said first inner form and said first outer form, said at least one panel being formed from a material having a coefficient of friction such that said at least one panel facilitates slidably moving at least one of said first inner form and said first outer form in the longitudinal direction relative to the poured and hardened concrete within said first cavity, wherein said at least one of said first inner form and said first outer form is configured to slidably move in the longitudinal direction relative to said at least one panel, wherein said first inner form has a height and said first outer form has a height measured along the longitudinal direction, a height of said at least one panel measured along the longitudinal direction is shorter than said first inner form height and said first outer form height.

13. The slip form construction system in accordance with claim 12, further comprising a second slip form assembly comprising:

a second lifting pole extending in the longitudinal direction;

a second inner form coupled to said second lifting pole; and a second outer form coupled to said second lifting pole opposite said second inner form and defining a second cavity in fluid communication with the first cavity for casting a second portion of the wall therebetween, wherein said first inner form and said first outer form are moveable about said first lifting pole in the longitudinal direction to facilitate moving said first inner form and said first outer form in the longitudinal direction relative to said second inner form and said second outer form, and at least one second slip form panel coupled to said at least one of said second inner form and said second outer form such that said at least one second slip form panel forms at least a partial inner surface of said at least one of said second inner form and said second outer form wherein concrete poured into said second cavity engages said at least one second slip form panel and is prevented from engaging an inner surface of said at least one of said second inner form and said second outer form.

14. The slip form construction system in accordance with claim 12, wherein said at least one panel comprises a first surface panel coupled to said first inner form and a second surface panel coupled to said first outer form, said first surface panel is substantially identical to said second surface panel.

15. The slip form construction system in accordance with claim 12, wherein said at least one panel comprises a textured surface configured to engage the concrete poured into said first cavity.

16. The slip form construction system in accordance with claim 12, wherein said at least one panel has a lower coefficient of friction than the concrete.

17. The slip form assembly construction system in accordance with claim 12, wherein said at least one panel is formed from a material having higher abrasion resistance, impact resistance, and wear resistance qualities than the hardened concrete.

* * * * *